US008201336B2

(12) United States Patent
De

(10) Patent No.: US 8,201,336 B2
(45) Date of Patent: Jun. 19, 2012

(54) RETRACTABLE UTILITY KNIFE

(75) Inventor: Huang Yuan De, Yangjiang (CN)

(73) Assignee: Olympia Tools International, Inc., City of Industry, CA (US)

( * ) Notice: Subject to any disclaimer, the term of this patent is extended or adjusted under 35 U.S.C. 154(b) by 960 days.

(21) Appl. No.: 12/114,234

(22) Filed: May 2, 2008

(65) Prior Publication Data

US 2009/0271990 A1 Nov. 5, 2009

(51) Int. Cl.
*B26B 1/08* (2006.01)

(52) U.S. Cl. ..... 30/162; 30/335; 30/339

(58) Field of Classification Search ..... 30/151–162, 30/335, 337–339
See application file for complete search history.

(56) References Cited

U.S. PATENT DOCUMENTS

| | | | | |
|---|---|---|---|---|
| 209,566 | A | | 11/1878 | Holland |
| 309,863 | A | | 12/1884 | McGovern |
| 493,075 | A | | 3/1893 | Evertz |
| 515,045 | A | | 2/1894 | Von Bultzingslowen |
| 705,441 | A | | 7/1902 | Putney |
| 1,444,324 | A | | 3/1919 | Brooks |
| 1,496,927 | A | | 6/1924 | Evers |
| 1,500,550 | A | | 7/1924 | D'Hont |
| 1,706,251 | A | | 10/1927 | Perry |
| 1,753,441 | A | | 4/1930 | Morehouse |
| 1,940,855 | A | | 6/1931 | Friedman |
| 2,051,721 | A | | 6/1935 | Kirangelos |
| 2,134,973 | A | | 1/1938 | Harwell |
| 2,284,128 | A | | 5/1939 | Bush |
| 2,265,775 | A | | 12/1939 | McNamara |
| 2,198,111 | A | * | 4/1940 | Gorbatenko et al. ..... 30/162 |
| 2,523,575 | A | | 4/1947 | Kassel |
| 2,569,080 | A | | 9/1951 | Trimble et al. |
| 2,599,439 | A | | 6/1952 | Drake |
| 2,601,723 | A | | 6/1952 | Keller |
| 2,605,545 | A | | 8/1952 | Weems |
| 2,735,176 | A | | 2/1953 | Costin |
| 2,632,244 | A | | 3/1953 | Belsky |
| 2,914,850 | A | | 10/1957 | Kunhl |
| 2,980,966 | A | | 9/1958 | Praeg |
| 3,171,201 | A | | 3/1965 | Carif |

(Continued)

FOREIGN PATENT DOCUMENTS

| | | |
|---|---|---|
| CA | 972140 | 8/1975 |

(Continued)

*Primary Examiner* — Laura M. Lee
(74) *Attorney, Agent, or Firm* — Lackenbach Siegel, LLP; Myron Greenspan

(57) ABSTRACT

A retractable knife includes an elongate handle and a blade holder slidingly mounted within the handle for sliding movements between a retracted position and an extended position. The blade holder is configured for receiving. A manually operable blade lock is formed on the holder and including a release member rotatably mounted on the blade holder. The release member having a first portion projecting beyond the handle and positioned to be actuated by a finger of a user while holding the handle. A second portion is movable with the first portion between a locking position in which the second portion is received with a notch of a blade and a releasing position in which the second position is removed from the blade notch to a position outside the notch of the blade. A spring normally rotates the release member to move the second portion to the locking position. Actuation of the release member by the finger of the user to overcome the spring moves the second portion to the releasing position and releases the blade.

26 Claims, 5 Drawing Sheets

U.S. PATENT DOCUMENTS 3,187,431 A 6/1965 Irmgard
3,192,624 A 7/1965 Gringer
3,234,649 A 2/1966 Preble et al.
3,306,297 A 2/1967 Voorhees et al.
3,577,637 A * 5/1971 Braginetz ..... 30/162
3,660,896 A 5/1972 Umholtz
3,683,496 A 8/1972 Johnson
3,708,881 A 1/1973 Bennett
3,845,554 A 11/1974 Joanis et al.
3,855,700 A 12/1974 Gerson et al.
3,872,591 A 3/1975 Quenot
3,879,847 A 4/1975 Roll
3,927,473 A 12/1975 Braginetz
3,943,627 A 3/1976 Stanley
3,964,162 A 6/1976 Gerson
4,017,969 A 4/1977 Stonebraker
4,068,375 A 1/1978 Rathbun et al.
4,109,380 A 8/1978 Anderson
4,134,206 A 1/1979 Beerman
4,170,062 A 10/1979 Machida
4,180,908 A 1/1980 Beerman
4,209,900 A 7/1980 Gilbert
4,232,445 A 11/1980 Ito
4,233,737 A 11/1980 Poehlmann
4,242,795 A 1/1981 Rollband et al.
4,261,104 A 4/1981 Cuscovitch
4,292,738 A 10/1981 Osada
4,320,576 A 3/1982 Beerman
4,347,665 A 9/1982 Glesser
4,393,587 A 7/1983 Kloosterman
4,408,396 A 10/1983 Scholl
4,509,260 A 4/1985 Gringer
4,517,741 A 5/1985 Castelluzzo
4,524,518 A 6/1985 West
4,570,342 A 2/1986 Baum
4,575,940 A 3/1986 Wenzel
4,604,805 A 8/1986 Krieger
4,620,369 A 11/1986 Gercken
4,660,284 A 4/1987 Decarollis
4,662,070 A 5/1987 Reddig
4,663,845 A 5/1987 Weimann
4,713,885 A 12/1987 Keklak et al.
4,761,882 A 8/1988 Silverstein
4,813,132 A 3/1989 Castelluzo
4,835,865 A 6/1989 Knoop
4,837,931 A 6/1989 Beerman
4,884,307 A 12/1989 Flood
4,899,443 A 2/1990 Beermann
4,930,218 A 6/1990 Jacoff
4,936,014 A 6/1990 Shaanan et al.
4,939,839 A 7/1990 Gorst
5,031,322 A 7/1991 Jacoff
5,086,562 A 2/1992 Jacoff
5,095,624 A 3/1992 Ennis
5,201,748 A 4/1993 Newman et al.
5,203,085 A 4/1993 Berns
5,255,443 A 10/1993 Schmidt
D346,319 S 4/1994 Lavallee et al.
5,303,469 A 4/1994 Yin-Han
5,344,424 A 9/1994 Roberts et al.
5,384,963 A 1/1995 Beerman
5,386,632 A 2/1995 Schmidt
5,400,512 A 3/1995 Brush
5,406,707 A 4/1995 Owens et al.
5,433,004 A 7/1995 Thompson et al.
5,481,804 A 1/1996 Platts
5,495,670 A 3/1996 Quinn
5,511,311 A 4/1996 Collins
5,513,405 A 5/1996 Bradbury et al.
5,581,890 A 12/1996 Schmidt
5,598,634 A 2/1997 Berns
5,613,300 A 3/1997 Schmidt
5,617,635 A 4/1997 Berns
5,647,132 A 7/1997 Berns
5,664,792 A 9/1997 Tseng
5,749,886 A 5/1998 Abidin et al.
5,806,189 A 9/1998 Bailey
5,813,121 A 9/1998 Gringer
5,864,954 A 2/1999 Harrington
5,870,828 A 2/1999 Polites
5,878,501 A 3/1999 Owens et al.
5,890,293 A 4/1999 Gamba
5,906,049 A 5/1999 Butts
5,906,050 A 5/1999 Gilbert
5,909,930 A 6/1999 Ragland et al.
5,940,970 A 8/1999 D'Ambro, Sr. et al.
5,966,816 A 10/1999 Roberson
5,966,817 A 10/1999 Lee
D420,270 S 2/2000 Martone
6,026,575 A 2/2000 Wonderley
6,070,326 A 6/2000 Berns
6,148,520 A 11/2000 Berns
6,161,290 A 12/2000 Takamasa
D437,767 S 2/2001 Van Deursen et al.
D438,084 S 2/2001 Khachatoorian
6,192,589 B1 2/2001 Martone et al.
D439,492 S 3/2001 Martone et al.
D440,858 S 4/2001 Gilbert
6,223,439 B1 5/2001 Wonderley
6,233,832 B1 5/2001 Berns
6,249,975 B1 6/2001 Lin
6,263,577 B1 7/2001 Wonderley
6,263,581 B1 7/2001 Forte
6,286,215 B1 9/2001 Panaccione
6,308,418 B1 10/2001 Sweet
6,314,646 B1 11/2001 Schmidt
6,330,749 B1 12/2001 Khachatoorian et al.
6,354,007 B1 3/2002 Scarla
6,357,120 B1 3/2002 Khachatoorian et al.
6,374,496 B1 * 4/2002 Hsu ..... 30/162
6,374,497 B1 4/2002 Sun
D458,526 S 6/2002 Budrow
6,415,514 B1 7/2002 Chun
6,438,849 B1 8/2002 Wonderley
D462,250 S 9/2002 Ping
D463,639 S 9/2002 Panfili
6,442,784 B1 9/2002 Bilger
6,446,340 B1 9/2002 Ping
6,449,850 B1 9/2002 Gilbert
6,502,311 B1 1/2003 Khachatoorian et al.
6,510,612 B1 1/2003 Cybulski
6,513,246 B2 2/2003 Ping
6,532,670 B1 3/2003 Berns
D473,778 S 4/2003 Hsu
6,543,140 B1 4/2003 Davis
6,546,632 B2 4/2003 Gilbert
6,550,144 B1 4/2003 Berns
6,553,674 B1 4/2003 Budrow
6,574,868 B1 * 6/2003 Overholt ..... 30/155
6,574,872 B2 6/2003 Roberts et al.
6,578,221 B2 6/2003 Ping
D478,493 S 8/2003 Martone et al.
6,645,216 B2 11/2003 Masury et al.
6,678,958 B1 1/2004 Budrow
6,688,003 B2 2/2004 Scarla
6,718,637 B1 4/2004 Ortner et al.
6,735,872 B1 5/2004 Chang
D492,179 S 6/2004 Hernandez et al.
6,742,260 B1 6/2004 Hsu
6,742,261 B2 6/2004 Ho
D495,939 S 9/2004 Ping
6,785,966 B2 9/2004 Berns
6,796,033 B2 9/2004 Owoc
6,802,126 B2 10/2004 Huang
6,829,827 B2 12/2004 Tseng
6,832,438 B1 12/2004 Gringer et al.
D501,782 S 2/2005 Ping
6,848,185 B2 2/2005 Tebo
D502,379 S 3/2005 Tseng
6,874,188 B2 4/2005 Johnson et al.
6,898,855 B2 5/2005 Jones et al.
6,907,668 B2 6/2005 Polei
6,915,577 B2 7/2005 Scala
D509,419 S 9/2005 Chung
D509,724 S 9/2005 Cook
6,948,250 B1 9/2005 Calafa et al.
D510,250 S 10/2005 Ping

| | | | | |
|---|---|---|---|---|
| 6,951,055 | B1 * | 10/2005 | Collins | 30/162 |
| 6,957,491 | B2 | 10/2005 | Van Deursen et al. | |
| 6,966,113 | B2 | 11/2005 | Fossella | |
| 6,968,622 | B2 | 11/2005 | Ping | |
| D512,296 | S | 12/2005 | Ping | |
| 6,971,178 | B2 | 12/2005 | Rowlay | |
| D516,403 | S | 3/2006 | Ping | |
| D517,893 | S | 3/2006 | Ping | |
| 7,007,392 | B2 | 3/2006 | Ping | |
| D519,019 | S | 4/2006 | Ping | |
| 7,028,406 | B2 | 4/2006 | Polei | |
| 7,040,022 | B2 | 5/2006 | Ping | |
| 7,051,443 | B2 | 5/2006 | Mueller | |
| D522,835 | S | 6/2006 | Ping | |
| 7,055,407 | B2 | 6/2006 | Gringer et al. | |
| D524,138 | S | 7/2006 | Chin | |
| D525,104 | S | 7/2006 | Samberg | |
| D526,877 | S | 8/2006 | Ping | |
| D526,878 | S | 8/2006 | Ping | |
| D528,895 | S | 9/2006 | Ping | |
| 7,107,688 | B1 | 9/2006 | Critelli et al. | |
| 7,134,207 | B2 | 11/2006 | Ping | |
| D535,171 | S | 1/2007 | Ping | |
| 7,185,435 | B1 | 3/2007 | Tseng | |
| 7,194,809 | B2 | 3/2007 | Skluzak | |
| D539,628 | S | 4/2007 | Ping | |
| D543,822 | S | 6/2007 | Ping | |
| D545,165 | S | 6/2007 | Ping | |
| D551,050 | S | 9/2007 | Ping | |
| D552,955 | S | 10/2007 | Ping | |
| 7,296,354 | B2 | 11/2007 | Van Deursen et al. | |
| D558,555 | S | 1/2008 | Huang | |
| D559,072 | S | 1/2008 | Fraga | |
| 7,316,070 | B2 | 1/2008 | Green | |
| 7,322,110 | B2 | 1/2008 | Hernandez | |
| 7,325,313 | B2 | 2/2008 | Gringer et al. | |
| D564,327 | S | 3/2008 | Wu | |
| 7,448,136 | B2 | 11/2008 | Huang | |
| 7,475,480 | B2 | 1/2009 | Votolato | |
| 7,784,189 | B2 * | 8/2010 | Polei | 30/162 |
| 7,930,829 | B2 * | 4/2011 | Ranieri et al. | 30/162 |
| 2002/0029426 | A1 * | 3/2002 | Seber et al. | 7/128 |
| 2002/0029480 | A1 | 3/2002 | Lin | |
| 2002/0096032 | A1 | 7/2002 | Peyrot et al. | |
| 2002/0144407 | A1 | 10/2002 | Gilbert | |
| 2002/0162229 | A1 | 11/2002 | Roberts et al. | |
| 2003/0037444 | A1 | 2/2003 | Chunn | |
| 2003/0079294 | A1 | 5/2003 | Deursen et al. | |
| 2003/0150116 | A1 | 8/2003 | Scala | |
| 2003/0154605 | A1 | 8/2003 | Chao | |
| 2003/0159290 | A1 | 8/2003 | Berns | |
| 2004/0040159 | A1 | 3/2004 | Fossella | |
| 2004/0045172 | A1 | 3/2004 | Rowlay | |
| 2004/0107580 | A1 | 6/2004 | Ping | |
| 2004/0139614 | A1 | 7/2004 | Tebo | |
| 2004/0173650 | A1 | 9/2004 | Berns | |
| 2004/0226173 | A1 | 11/2004 | Ping | |
| 2004/0226175 | A1 | 11/2004 | Ping | |
| 2004/0237312 | A1 | 12/2004 | Hernandez et al. | |
| 2004/0250426 | A1 | 12/2004 | Polei | |
| 2005/0055833 | A1 * | 3/2005 | Scarla | 30/156 |
| 2005/0138816 | A1 | 6/2005 | Ping | |
| 2005/0155226 | A1 | 7/2005 | Van Deursen et al. | |
| 2005/0188541 | A1 | 9/2005 | Brown et al. | |
| 2005/0193566 | A1 | 9/2005 | Brown | |
| 2005/0193567 | A1 | 9/2005 | Ho | |
| 2005/0193568 | A1 | 9/2005 | Peyrot | |
| 2005/0204567 | A1 | 9/2005 | Ping | |
| 2005/0235499 | A1 | 10/2005 | Van Deursen et al. | |
| 2005/0278955 | A1 * | 12/2005 | Lee | 30/153 |
| 2005/0283983 | A1 | 12/2005 | Huang | |
| 2006/0026844 | A1 | 2/2006 | Ping | |
| 2006/0059693 | A1 | 3/2006 | Fossella | |
| 2006/0137190 | A1 | 6/2006 | Deursen et al. | |
| 2006/0242841 | A1 | 11/2006 | Fossella | |
| 2007/0006466 | A1 | 1/2007 | Ping | |
| 2007/0011882 | A1 | 1/2007 | Ping | |
| 2007/0028454 | A1 * | 2/2007 | Ranieri et al. | 30/162 |
| 2007/0028455 | A1 | 2/2007 | Ranieri et al. | |
| 2007/0068003 | A1 | 3/2007 | Schmidt | |
| 2007/0074402 | A1 | 4/2007 | Hernandez | |
| 2007/0107233 | A1 | 5/2007 | Polei | |
| 2007/0119056 | A1 | 5/2007 | Polei | |
| 2007/0130777 | A1 | 6/2007 | Ping | |
| 2007/0130779 | A1 | 6/2007 | Tatum | |
| 2007/0157472 | A1 | 7/2007 | Critelli | |
| 2008/0110028 | A1 | 5/2008 | Seber | |
| 2008/0141539 | A1 | 6/2008 | Co | |
| 2008/0189956 | A1 | 8/2008 | Polei | |
| 2008/0282546 | A2 | 11/2008 | Ranieri | |
| 2009/0113725 | A1 * | 5/2009 | DeLillo | 30/335 |
| 2009/0165309 | A1 * | 7/2009 | Kamb et al. | 30/161 |
| 2010/0043235 | A1 * | 2/2010 | Hao | 30/162 |
| 2010/0281696 | A1 * | 11/2010 | Hao et al. | 30/152 |
| 2011/0041344 | A1 * | 2/2011 | De et al. | 30/162 |

FOREIGN PATENT DOCUMENTS

| | | |
|---|---|---|
| DE | 29819618 | 3/1999 |
| EP | 0128711 | 12/1984 |
| EP | 0178040 | 4/1986 |
| EP | 0240179 | 10/1987 |
| EP | 0255951 | 2/1988 |
| EP | 1050385 | 11/2000 |
| EP | 1063065 | 12/2000 |
| EP | 1075908 | 2/2001 |
| EP | 1077118 | 2/2001 |
| EP | 1422031 | 5/2004 |
| EP | 1834740 | 9/2007 |
| EP | 1982804 | 10/2008 |
| GB | 2277048 | 4/1993 |
| WO | WO9008633 | 8/1990 |
| WO | WO9412324 | 6/1994 |
| WO | WO 9415762 | 7/1994 |
| WO | WO9832572 | 7/1998 |
| WO | WO2004/106012 | 12/2004 |
| WO | WO2005/046945 | 5/2005 |
| WO | WO2007/042001 | 4/2007 |
| WO | WO2008/060304 | 5/2008 |

* cited by examiner

RETRACTABLE UTILITY KNIFE

BACKGROUND OF THE INVENTION

1. Field of the Invention

The present invention generally related to a hand tools, and more specifically to a retractable utility knife with a quick release blade mechanism.

2. Description of the Prior Art

Conventional utility knives have various types of structures including fixed, foldable and retractable. They are generally used to cut paper, fabric, and leather. The Chinese Patent Application No. 93208241.6 (Publication Date: Jun. 22, 1994) disclosed "a retractable rope-cut utility knife", in which a blade stored in a handle is extended out step by step by moving a slider. However, it is not convenient to replace the blade. The Chinese Patent Application No. 03223149.0 (Publication Date: Dec. 24, 2003) disclosed "a combined utility knife". It is convenient to replace a blade by arranging the blade in a groove of the handle assembly and using a top cover in connection with a lock member. However, the following problems exist. The structure is complex; when replacing a blade, a user needs to release the lock member first and then rotate the top cover, which is complicated and inconvenient. The Chinese Patent Application No. 20042010202117.2 (Publication Date: Feb. 8, 2006) disclosed "a utility knife" in which a blade is arranged in a mounting groove of a handle assembly and a fixing hole is provided in the handle assembly. A bolt anchored in the fixing hole secures the blade. This utility knife is also disadvantageous because extra tools are used when the blade is replaced.

SUMMARY OF THE INVENTION

Accordingly, it is an object of the invention to provide a retractable utility knife which does not include the disadvantages inherent in prior art utility knives.

It is another object of the invention to provide a retractable utility knife that is simple in construction and economical to manufacture.

It is still another object of the invention to provide a retractable utility knife as in the previous objects which permits one hand operation for releasing a blade from a retractable utility knife.

It is yet another object of the invention to provide a retractable utility knife of the type under discussion that is easy and convenient to use.

It is a further object of the invention to provide a retractable utility knife as suggested in the previous objects that is ergonomically configured to allow a blade to be released with the thumb of a user while the blade is being held in the same hand of the user.

It is still a further object to provide a utility knife as in the previous objects that has a slim profile and easy to store and transport.

In order to achieve the above objects, as well as others which will become apparent hereafter, a retractable utility knife in accordance with the present invention includes an elongate handle generally defining an axis. A blade holder is slidingly mounted within the handle for sliding movements relative to the handle along the axis between a retracted position and an extended position. The blade holder is configured for receiving at least a portion of a blade provided with one edge formed as a cutting edge and an opposing edge formed with a notch. A manually operable blade lock is formed on the blade holder and includes a release member rotatably mounted on the blade holder. The release member has a first portion projecting beyond the blade holder and positioned to be actuated by a finger of a user while holding the handle. A second portion of the release member is arranged to move with the first portion and moveable between a locking position in which the second portion is received within the notch of the blade and a releasing position in which the second portion is removed from and is positioned beyond the notch of the blade. Biasing means in the form of a spring is provided for normally rotating the release member to move the second portion to the locking position. In this manner, actuation of the release member by the finger of the user to overcome the biasing forces of the spring moves the second portion to the releasing position and the blade can be quickly and conveniently removed from the blade holder.

BRIEF DESCRIPTION OF THE DRAWINGS

Other objects and features of the present invention may become clear from the following description taken in conjunction with the preferred embodiments thereof with reference to the accompanying drawings, in which.

DESCRIPTION OF PREFERRED EMBODIMENT

Figure 1:
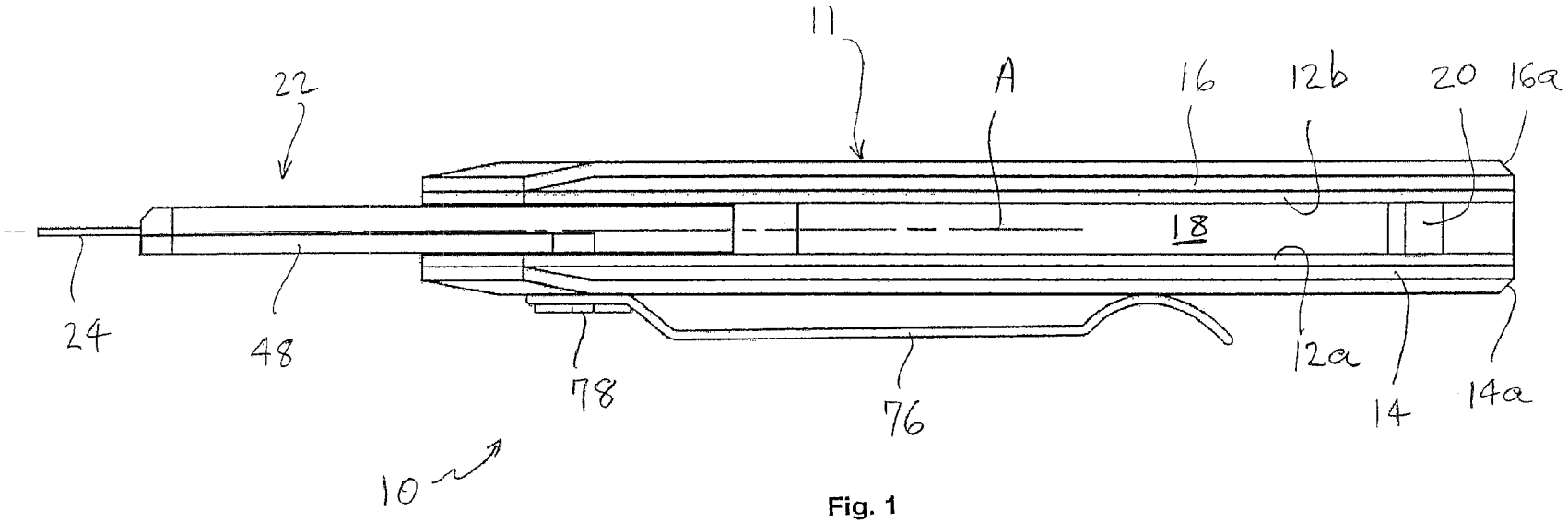
FIG. 1 is a bottom plan view of a retractable utility knife in accordance with the invention, shown with the blade and blade carriage in an extended position.

Referring know specifically to the Figures, in which identical or similar parts are designated by the same reference numerals throughout, and first referring to FIGS. 1-4, a retractable utility knife in accordance with the present invention is generally designated by the reference numeral 10.

Figure 4:
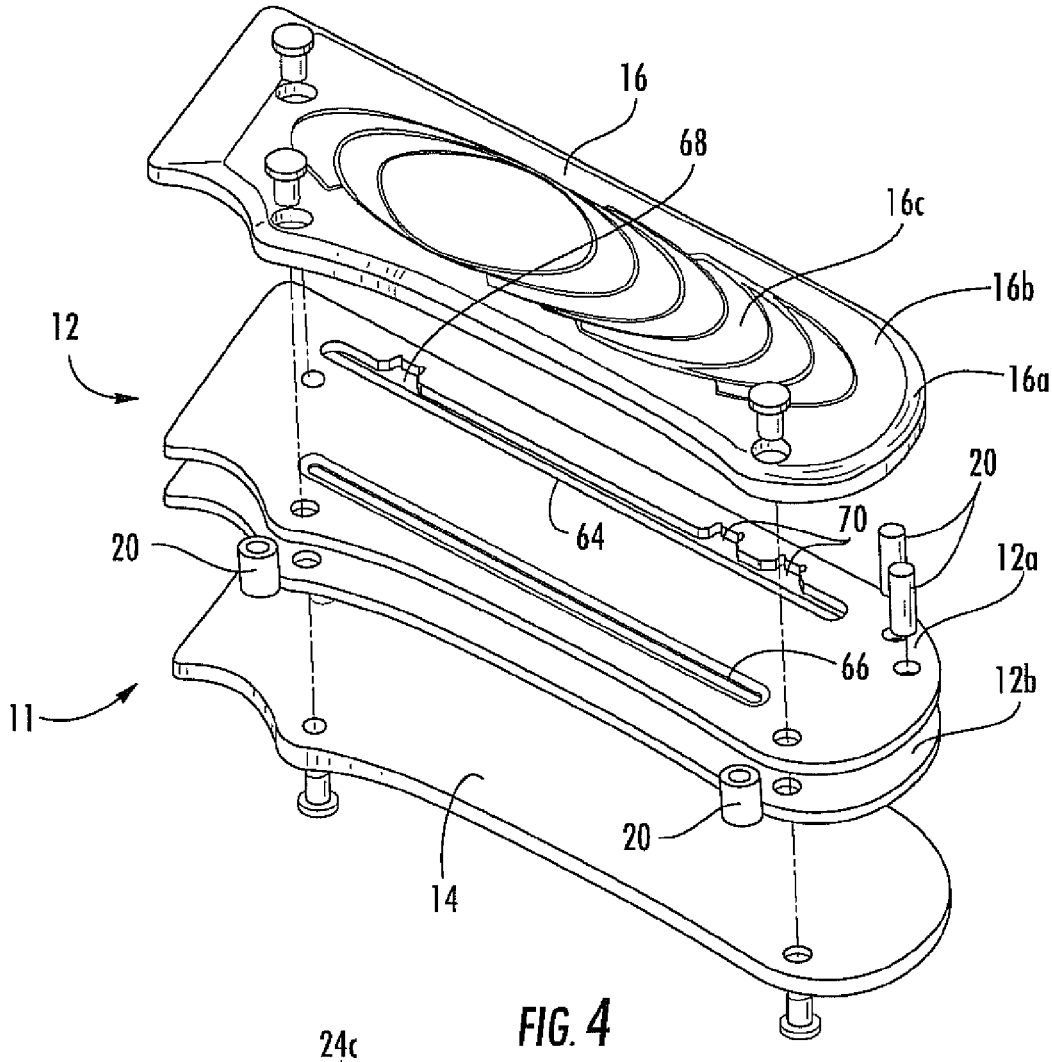
FIG. 4 is an exploded perspective view of the handle forming part of the retractable utility knife shown in FIGS. 1-3.

The retractable utility knife 10 includes a handle 11, an exploded view of which is shown in FIG. 4. The handle 11 is generally elongate, as shown, and generally defines an axis A along its length direction. The handle 11 is preferably ergonomically configured to provide a comfortable grip by a user using the utility knife.

Figure 2:
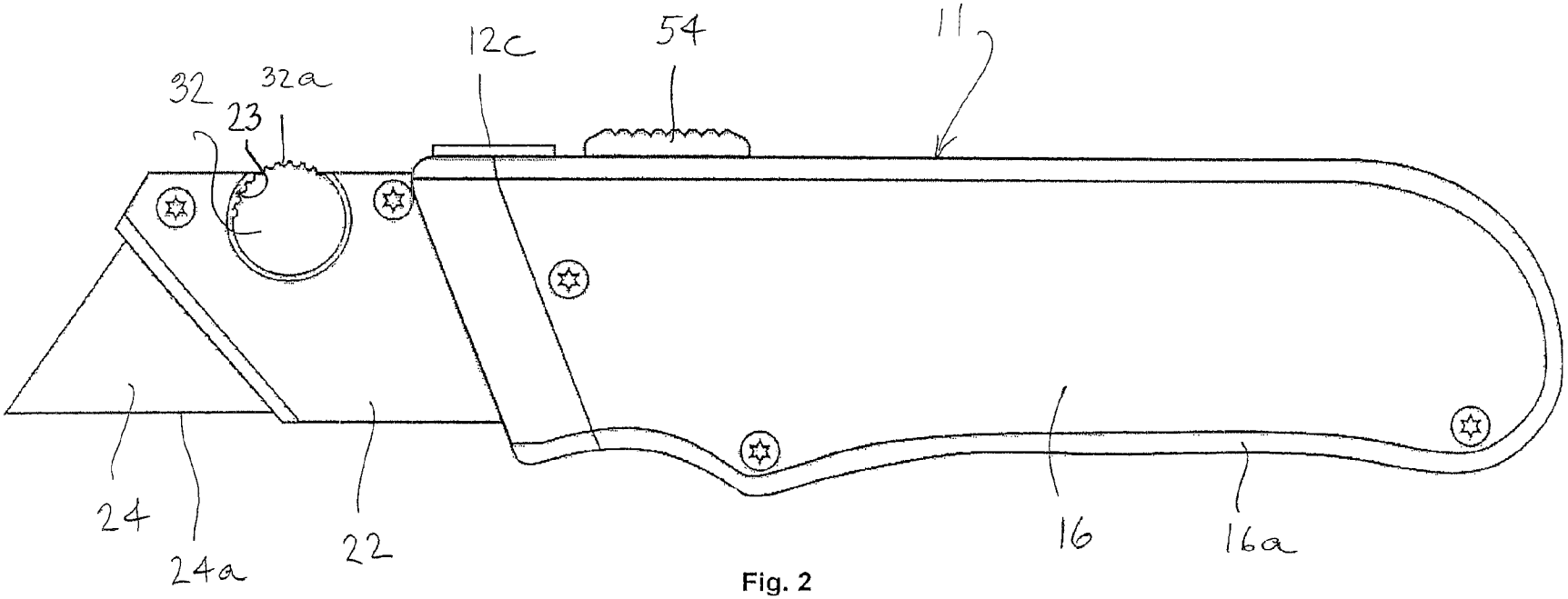
FIG. 2 is a right side elevational view of the utility knife shown in FIG. 1.
Figure 3:
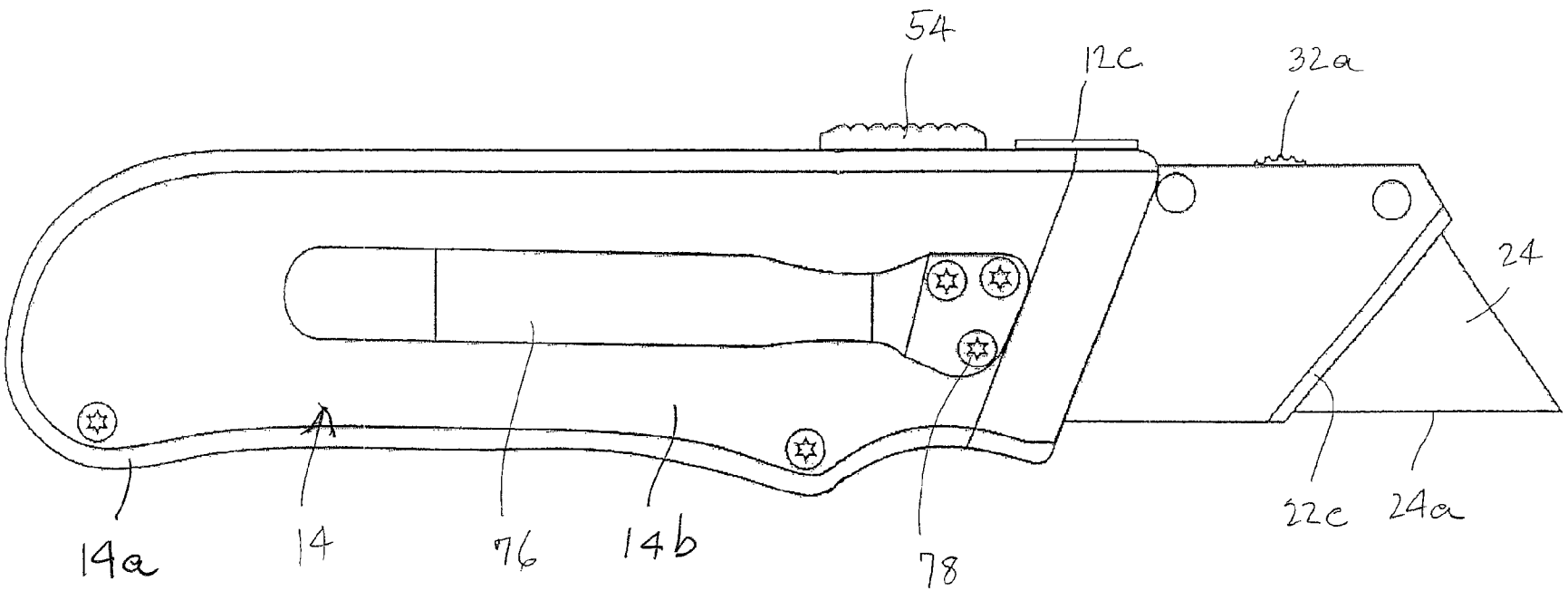
FIG. 3 is a rear side elevational view of the utility knife shown in FIGS. 1-2.

The handle 11 is formed of an inner frame 12 which includes spaced right and left plates or rails 12*a*, 12*b* separated a suitable or desired distance by means of a bridging strip 12*c*, shown in FIGS. 2 and 3. In the presently preferred embodiment, the plates or rails 12*a*, 12*b* are spaced approximately 0.25" apart. The inner frame 12 is, in accordance with the present invention, formed of stainless steel, although other rigid materials can be used. Since the bridging strip 12*c* is formed at the remote end of the handle 11, suitable spacers, to be described, are provided for maintaining the right and left plates or rails 12*a*, 12*b* at a fixed spacing from each other. Preferably, the inner facing surfaces of the plates or rails 12*a*, 12*b* are polished to provide smooth surfaces that minimize sliding friction.

A right cover 14 is mounted on the right plate or rail 12*a*, the right cover being provided with a beveled edge 14*a*, as shown, and exposed right surface 14*b*. Similarly, a left cover 16 is provided with a bevel 16*a* and exhibits a left surface 16*b* when mounted on the left plate or rail 12*b*. The right and/or left covers 14, 16 are preferably provided with suitable ornamentation 16*c*, as suggested in FIG. 4.

A gap or space 18 resulting between the right and left rails or plates 12*a*, 12*b* is maintained at a desired spacing by means of spacers 20 of the type shown in FIGS. 1 and 4. Any suitable number of spacers may be provided to maintain the inner frame essentially fixed or rigid and the gap or space 18 uniform. In the presently preferred embodiment the spacing between the inner, facing surfaces of the plates or rails 12*a*, 12*b* is approximately 3/16".

Mounted for sliding movements within the inner frame 12, or between the right and left plates or rails 12*a*, 12*b* is a blade holder or carriage 22 that is received within the gap or space 18 of the inner frame 12 for sliding movements relative to the frame 12 and the handle 11 essentially along the length direction or axis A of the handle 11. The carriage is preferably formed of stainless steel, although other comparable materials can also be used. The lateral right and left surfaces of the carriage facing the inner surfaces of the rails or plates 12*a*, 12*b* are preferably polished to provide smooth surfaces to minimize sliding friction with the smooth, polished, facing surfaces of the rails or plates. The thickness or transverse dimension of the carriage 22 is selected to allow the carriage to be received within the gap or space 18 to allow free longitudinal sliding movements without any significant lateral play. Preferably, a suitable lubricant, such as oil or silicone-based lubricants, are applied between the frame 12 and the carriage 22 to provide smooth movements involving little friction.

Figure 5:
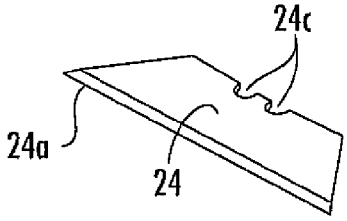
FIG. 5 is a perspective view of a utility blade of the type that can be used with the retractable utility knife.

The carriage or blade holder 22 is provided with a receiving cavity for receiving at least a portion of a blade of the type generally shown in FIG. 5. The blade 24 is a conventional trapezoidal-shaped utility knife blade of the type commonly used in numerous utility knives. The blade is typically formed along its lower or larger base with a cutting edge 24*a*, while the opposing upper or shorter base is formed with at least one notch 24*c*. Typically, such blades are provided with two spaced notches 24*c* as shown so that with most utility knives in which these blades are used they can be reversed and utilized irrespective of which pointed edge extends beyond the utility knife during use.

Referring specifically to FIGS. 6-9, the carriage or blade holder 22 is shown formed of a solid block portion 22*a*, at the rear or proximate end of the carriage 22, while the forward or remote end of the carriage 22 is provided with the blade receiving cavity 22*b*, in which material has been removed, as shown, to provide various cavities or recesses to be described. The forward or remote edge 22*c* is inclined to expose a triangular section of the blade 24 when it is exposed outside of the carriage during use.

Figure 8:
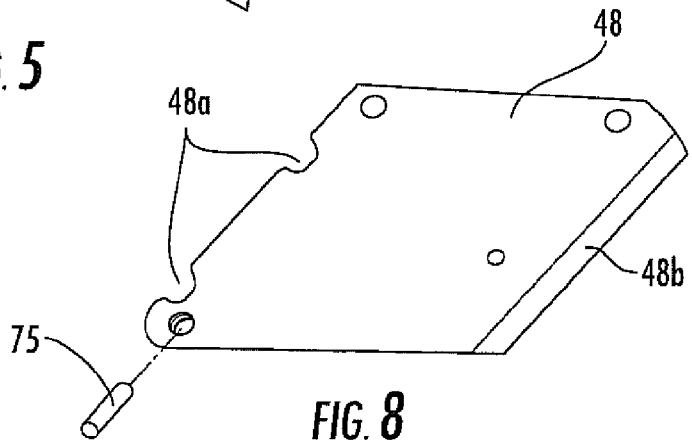
FIG. 8 is a side elevational view of the cover plate removed from the carriage and normally covering the blade locking and releasing mechanism shown in FIG. 7.
Figure 7:
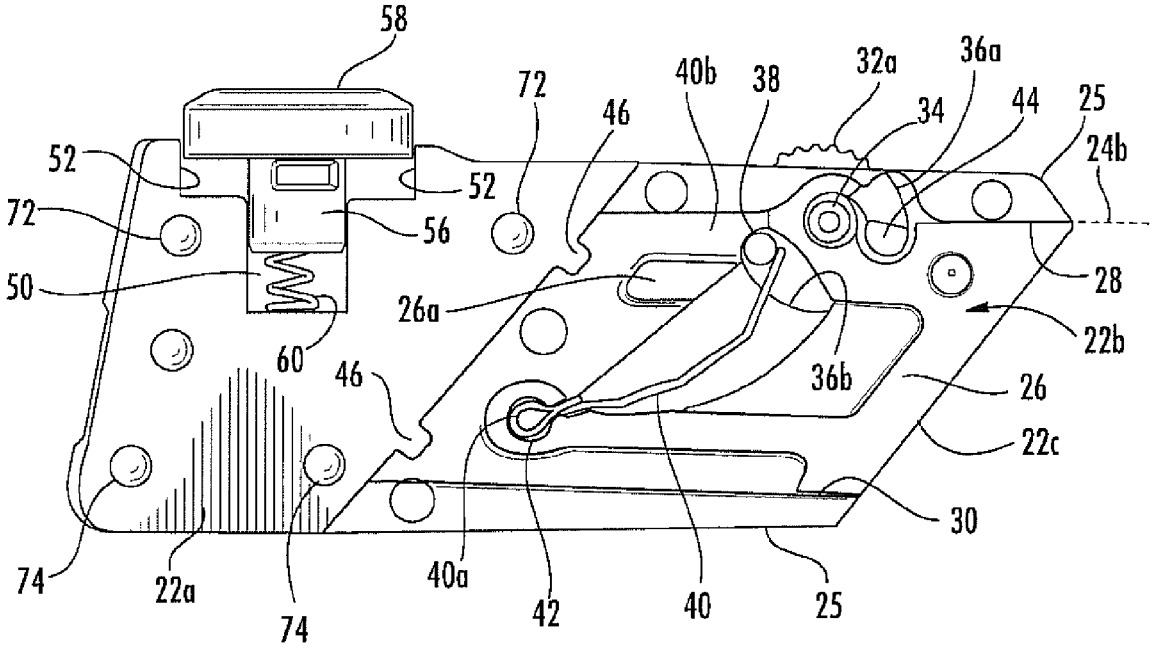
FIG. 7 is similar to FIG. 6, but showing the reverse side of the carriage and further showing a cover plate removed from the forward or front end of the carriage to illustrate the details of the locking and releasing disk and the manner in which it is biased and used to selectively lock or release a blade received within the carriage or blade holder.

Referring specifically to FIG. 7, the front or remote portion 22*b* of the carriage 22 is formed with a number of cavities having different depths. Thus, along the upper and lower edges there are provided mounting strips on which a cover plate 48 can be attached to enclose the various cavities or recesses shown in FIG. 8. The cover plate 48 is shown in FIG. 8.

The upper mounting strip 25 forms a step or upper guide edge 28 while the lower mounting strip 25 forms a lower step or upper guide edge 30, the guide edges being parallel to each other and together define a guide surface 26 against which one surface of the blade 24 can slide. Additional bosses, such as boss 26*a*, can be provided whose outer surfaces are co-extensive with the guide surface 26 to provide support and facilitate sliding movements of the blade relative to the guide surface 26.

Figure 6:
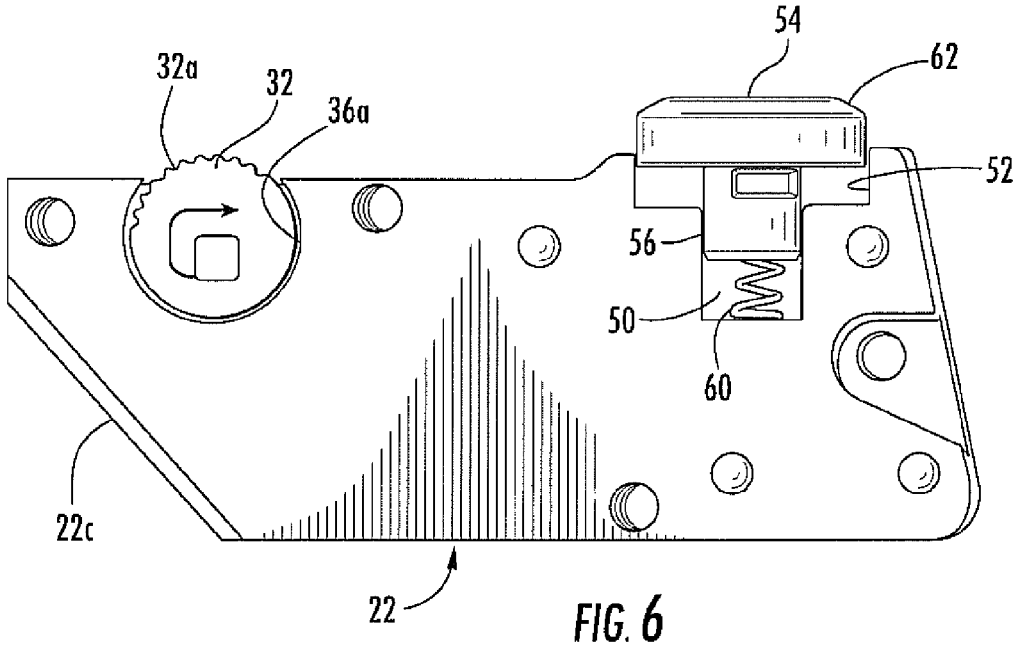
FIG. 6 is a right side elevational view of the carriage slidably mounted within the handle of the retractable utility knife, showing the details of a release button when it is in its upwardly extended, carriage-locking position.

Referring to FIG. 6, a circular recess 23 is provided in the face or outer surface of the carriage 22, as shown, the radial distance of the center of the circular recess being less than its radius from the upper edge of the carriage, as shown, so that an upper arc of the circular recess 23 forms an opening through the upper edge of the carriage. A circular release disk 32 is rotatably mounted on a suitable pivot pin 34 (FIG. 7) so that at least a portion of the release disk extends or projects above the upper edge of the carriage as shown. Preferably, the portion of the release disk 32 that projects above the upper edge of the carriage is provided with a ribbed or knurled edge, as shown, to facilitate gripping with a finger of a user.

Referring to FIG. 7, a cutout or opening 36*a*, shown as an arcuate cavity, is provided behind the release disk 32 and, similarly, a second cutout 36*b* is provided somewhat diametrically opposite to the cutout 36*a*. A biasing finger 38, attached to or forming a part of the release disk 32 projects through the cutout 36*b*. However, the biasing finger 38 does not project beyond the guide surface 26 so as not to interfere with any blade supported on the guide surface 26. A suitable biasing member is provided for engaging the biasing finger 38. The biasing member in FIG. 7 is shown to be a leaf spring 40 having the fixed end 40*a* received within a recess 42 and a moveable or free end 40*b* that engages the biasing finger 38 and urges the biasing finger 38 upwardly, as shown in FIG. 7, to rotate the release disk 32 in a generally clockwise direction.

A stop finger 44 projects transversely from the release disk 32 into the arcuate cutout 36*a*. However, the stop finger 44 projects beyond the guide surface 26 by a distance that is substantially equal to the thickness of the blade 24. The stop pin or finger 44 is configured so that in a locking position of the blade, as shown in FIG. 7, the stop finger or pin 44 is received within one of the notches 24*c* which fixes the position of the blade and prevents it from moving longitudinally along the steps or guide edges 28, 30 relative to the carriage 22. It will be evident that when a user places his or her finger, typically the thumb, on the release disk 32 and pulls the projecting top edge of the disk and urges the disk towards the proximate or towards the rear of the handle 11, the release disk rotates in a counterclockwise direction, as viewed in FIG. 7, against the biasing forces of the spring 40. The spring 40 is selected to bias the release disk 32 to its normal locking position although readily rotatable to an unlocking position, when the stop pin or finger 44 is elevated or lifted out of one of the notches 24*c* of the blade without too much force or resistance. Like the biasing finger 38, the spring 40 is placed within a cavity below the plane of the guide surface 26 so that the movements of the spring and the biasing finger 38 do not contact and do not interfere with the members of the blade.

When assembled, the cover plate 48 can be positioned over the recessed portions 22*b* of the carriage, at which time the tabs 46 are received within the recesses 48*a* of the cover plate and suitable fasteners can be used to secure the cover plate to the rest of the carriage. The thickness of the steps 28, 30 substantially correspond to the thickness of the blade so that when a cover plate 48 is secured onto the mounting strips 25 a receiving space is maintained for allowing a blade to be slidably inserted or removed from the carriage or blade holder 22 when the release disk 32 is rotated in a counterclockwise direction to lift the stop finger or pin 44 to avoid interference with the free movements of the blade.

Referring to FIGS. 6 and 7, the rear or proximate end of the carriage is provided with a T-shaped slot that includes a lower narrow slot 50 and a wide upper slot 52, both slots being substantially aligned along a direction that is generally normal or perpendicular to the lengthwise direction or axis A of the handle 11. A release button 54, which may be formed of a slip resistant material, such as rubber or rubber-like material, is formed with a downwardly depending post or stem 56. The axial length of the release button 54 is somewhat less than the width of the wide slot 52 while the axial or lengthwise dimension of the narrow slot 50 is somewhat greater than the dimension of the stem, as shown, so that the stem 56 can be received within the narrow slot 50 with some clearance and, likewise, the release button 54 can be received with some clearance within the wide slot 52. In this way, the release button 54 can move downwardly or upwardly within the slots of the resulting T-shaped slot. A suitable spring 60, such as helical spring, is arranged between the lower most surface of the narrow slot 50 and captured between that surface and the stem 56 so that the helical spring 60 normally biases or urges the release button 54 to move in an upward direction, although a downward pressure on the release button 54 by a user can move the release button downwardly into the wide slot 52 against the action of the spring.

Figure 9:
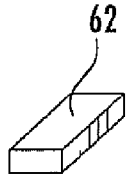
FIG. 9 is a perspective view of a flat strip receivable within a transverse through hole or slot in the release button shown in FIGS. 6 and 7 for selectively engaging indents within the handle for selectively locking or releasing the carriage from longitudinal sliding movements relative to the handle.

A transverse slot 58 is formed within the post or stem 56 though with which a transverse bar or pin 62 may be inserted, as shown in FIG. 6. Referring to FIG. 4, the right and left rails 12*a*, 12*b* are provided with upper tracks 64 that extend along the longitudinal direction along the axis A of the handle. Similarly, corresponding lower tracks 66 are provided in each of the rails or plates 12*a*, 12*b* that are parallel to the upper tracks 64. At least two indents are provided in the upper tracks 64, extending in an upper direction away from the lower tracks 66 as shown in FIG. 4. In the embodiment shown, a single front indent 68 is provided at the front or remote end of the upper tracks 64 and two spaced rear indents 70 are provided at the rear or proximate ends of the upper tracks. Referring to FIG. 9, a transverse bar or pin 62, when placed within the slot 58, is dimensioned to project to each side of the stem or post 56 to be receivable within the upper tracks 64 for sliding movements within the upper tracks. The location of the slot 58 and, therefore, the transverse bar or pin 62 is selected so that when the helical spring 60 urges the stem 56 upwardly this biases the bar or pin 62 upwardly and, when juxtaposed against one of the indents 68, 70, the bar or pin 62 will be urged into an indent below which it is placed. It should be evident that once the bar or pin 62 is received within one of the indents 68, 70 this locks the carriage 22 from longitudinal sliding movements along the axis A of the carriage. However, when the release button 54 is pressed downwardly, against the action of the spring 60, the bar or pin 62 is urged out of a recess in which it has been positioned, at which time a longitudinal or axial force on the release button forwardly or rearwardly causes the carriage or blade holder 22 to slide forwardly or rearwardly, depending on the direction of the force applied by the user's thumb. This allows a user to selectively lock the carriage, and any blade secured therein by the release disk 32, to slide forwardly to an extended position shown in FIGS. 1-3 or rearwardly, at which time the carriage or blade holder is locked or secured in its retracted position.

To facilitate sliding and to stabilize the movements of the carriage between extended and retracted positions, there are provided upper holes 72 and lower holes 74 in the carriage through which suitable stabilizing pins 75 (one shown in FIG. 8) may extend, pins dimensioned to be received within the tracks 64, 66 with some but little clearance. Two upper holes 72 and two lower holes 74 are shown in FIG. 7, these holes being arranged along substantially parallel lines spaced to correspond to the spacing between the speed tracks 64, 66. This ensures that the carriage moves longitudinally along the handle 11 with a smooth stable motion and without any rotational movement components.

Suitable fasteners, such as screws or rivets may be used to secure the cover plate 48 to the carriage and the covers 14, 16 to the inner frame 12. The specific fasteners used are not critical for purposes of the invention.

In the embodiment illustrated, there is also provided an optional spring clip 76 secured to the right cover 14 by means of rivets or screw 78.

By making the release button 54 from an elastameric or other non-slip resistant material this makes it easier for a user to push the release button downwardly and rearwardly or downwardly and forwardly without slippage.

With the retractable knife disclosed the utility knife has a carriage or blade holder 22 that, with the blade fixed thereon, can be fully retracted within the handle 11 or extended as shown in FIG. 1-3. It will be appreciated that once the carriage or blade holder is fully retracted within the handle the overall length of the utility knife becomes significantly shorter than the extended length. The design makes it possible to make the utility knife relatively slim and short and portable both within a tool box or tool bag, on the person, clipped to a belt, etc. Movements of the carriage from a retracted to extended positions, as well as quick release of the blade by rotation of the release disk are all one hand operations.

While the invention has been shown and described in connection with a preferred form of an embodiment it will be understood that modifications may be made without the departure from the scope or spirit of the invention.

The invention claimed is:

1. Retractable knife comprising an elongate handle defining a handle axis; a release button mounted for movements along said handle axis; a blade holder slidingly mounted within said handle responsive to actuation of said release button for sliding movements along said handle between a retracted position and an extended position in which at least a portion of said blade holder extends beyond said handle and having an upper edge, receiving means within said blade holder for receiving at least a portion of a blade provided with one edge formed with a cutting edge and opposing edge formed with a notch; and a manually operable blade lock formed on said portion of said blade holder and comprising a release member rotatably mounted on said blade holder, said release member having a first portion on said blade holder and mounted to be actuated by movement of a finger of the same hand of a user holding said handle along a direction substantially parallel to said handle axis, and a second portion mounted on said first portion for movements with said first portion between a locking position in which said second portion is received within a notch of a blade and a releasing position in which said second portion is removed from the blade notch to a position beyond the notch of the blade, said release member being substantially in the form of a disc having an axis of rotation substantially normal to said handle axis and rotatably mounted on said blade holder for rotation about said release member axis of rotation, said first portion at least partially projecting above said upper edge of said blade holder to always be exposed for engagement by the user in both said blade locking and blade releasing positions when said release member is actuated while said blade holder is extended along said handle axis beyond said handle at a position spaced from said release button in the direction of the blade to be removed, and biasing means for normally moving said release member to move said second portion to said locking position, whereby actuation of said release member by the finger of the user to overcome said biasing means moves said second portion to said releasing position for releasing the blade so that it can be withdrawn from said receiving means.

2. Retractable knife as defined in claim 1, wherein said release member comprises a circular disc.

3. Retractable knife as defined in claim 2, wherein said first portion comprises an arc of said disc that projects beyond said upper edge of said blade holder.

4. Retractable knife as defined in claim 3, wherein said first portion is provided with gripping means for enhancing friction when gripped by a finger of a user seeking to rotate said disc against the action of said biasing means.

5. Retractable knife as defined in claim 4, wherein said gripping means comprises a non-smooth edge along said arc.

6. Retractable knife as defined in claim 1, wherein said second portion is fixedly mounted on said first portion.

7. Retractable knife as defined in claim 1, wherein said blade holder is received within a longitudinal space or gap within said handle with little clearance, facing surfaces of said blade holder and handle being polished to minimize sliding friction.

8. Retractable knife as defined in claim 7, further comprising a lubricant at said facing surfaces to reduce sliding friction.

9. Retractable knife as defined in claim 1, further comprising a blade holder lock on said blade holder having a gripping portion extending beyond said handle to be engageable by the thumb of a user and for selectively locking said blade holder against movements between said extended and retracted positions and releasing said blade holder for movement from one of said positions to the other.

10. A knife as defined in claim 1, wherein said handle has first and second handle portions, said handle portions being connected to each other in spaced relationships to form a space between said handle portions and a generally open periphery including a front aperture, a rear aperture, a top aperture and a bottom aperture;

a utility blade; and said blade holder being configured to cover at least a portion of said utility blade, wherein said blade holder is telescopically movable relative to the handle through said front aperture between an extended position and a retracted position.

11. The knife of claim 10, further including a button configured to move the blade holder between the extended position and the retracted position, wherein said button extends through said top aperture.

12. The knife of claim 11, wherein said button is configured to move along said top aperture as said blade holder moves between said extended position and said retracted positions.

13. The knife of claim 10, wherein said handle includes an track formed on an internal surface thereof and said second handle portion include a corresponding track on an internal surface thereof parallel to said internal track on said first handle portion.

14. The knife of claim 13, wherein said blade holder includes at least one pin member configured to slide in said tracks as said blade holder moves between the extended and retracted positions.

15. The knife of claim 13, wherein said tracks include a front indent proximate to said front aperture and a rear indent proximate to said rear aperture.

16. The knife of claim 13, wherein said button is movable between an extended blade holder locking position and a retracted blade holder releasing position and wherein said button is normally biased in the extended locking position.

17. The knife of claim 13, wherein the button includes a protrusion member that interacts with said front indent to lock said blade holder in the extended position and said rear indent to lock the blade holder in the retracted position.

18. Retractable knife comprising an elongate handle; defining a handle axis: a release button mounted for movements along said handle axis; a blade holder slidingly mounted within said handle responsive to actuation of said release button for sliding movements relative to said handle between a retracted position and an extended position in which at least a portion of said blade holder extends beyond said handle and having an upper edge, receiving means within said blade holder for receiving at least a portion of a blade provided with one edge formed with a cutting edge and opposing edge formed with a notch; and a manually operable blade lock formed on said portion of said blade holder and comprising a release member rotatably mounted on said blade holder, said release member having a first portion on said blade holder and mounted to be actuated by movement of a finger of the same hand of a user holding said handle along a direction substantially parallel to said handle axis, and a second portion mounted on said first portion for movements with said first portion between a locking position in which said second portion is received within a notch of a blade and a releasing position in which said second portion is removed from the blade notch to a position beyond the notch of the blade, said release member being substantially in the form of a disc having an axis of rotation substantially normal to said handle axis and rotatably mounted on said blade holder for rotation about said release member axis of rotation, said first portion at least partially projecting above said upper edge of said blade holder to always be exposed for engagement by the user in both said blade locking and blade releasing positions when said release member is actuated while said blade holder is extended along said handle axis beyond said handle at a position spaced from said release button in the direction of the blade to be removed, and biasing means for normally moving said release member to move said second portion to said locking position, said blade holder being received within a longitudinal space or gap within said handle with little clearance, facing surfaces of said blade holder and handle being polished to minimize sliding friction, whereby actuation of said release member by the finger of the user to overcome said biasing means moves said second portion to said releasing position for releasing the blade so that it can be withdrawn from said receiving means.

19. Retractable knife as defined in claim 18, further comprising a lubricant at said facing surfaces to reduce sliding friction.

20. Retractable knife comprising an elongate handle; defining a handle axis: a release button mounted for movements along said handle axis; a blade holder slidingly mounted within said handle responsive to actuation of said release button for sliding movements relative to said handle between a retracted position and an extended position in which at least a portion of said blade holder extends beyond said handle and having an upper edge, receiving means within said blade holder for receiving at least a portion of a blade provided with one edge formed with a cutting edge and opposing edge formed with a notch; and a manually operable blade lock formed on said portion of said blade holder and comprising a release member on said blade holder, said release member having a first portion rotatably mounted on said blade holder and mounted to be actuated by movement of a finger of the same hand of a user holding said handle along a direction substantially parallel to said handle axis, and a second portion mounted on said first portion for movements with said first portion between a locking position in which said second portion is received within a notch of a blade and a releasing position in which said second portion is removed from the blade notch to a position beyond the notch of the blade, said release member being substantially in the form of a disc having an axis of rotation substantially normal to said handle axis and rotatably mounted on said blade holder for rotation about said release member axis of rotation, said first portion at least partially projecting above said upper edge of said blade holder to always be exposed for engagement by the user in both said blade locking and blade releasing positions when said release member is actuated while said blade holder is extended along said handle axis beyond said handle at a position spaced from said release button in the direction of the blade to be removed, and biasing means for normally moving said release member to move said second portion to said locking position, said handle having a thickness or width in a direction normal to said axis that is approximately 0.5", whereby actuation of said release member by the finger of the user to overcome said biasing means moves said second portion to said releasing position for releasing the blade so that it can be withdrawn from said receiving means.

21. Retractable knife as defined in claim 20, wherein said blade holder has a thickness or width in said normal direction that is approximately 50% of said width of said handle.

22. Retractable knife as defined in claim 21, wherein said width of said blade holder is approximately 3/16".

23. Retractable knife as defined in claim 20, wherein said knife defines an axis and has a longitudinal length along said axis of approximately 4.5" in said retracted position of the blade.

24. Retractable knife as defined in claim 23, wherein said knife has a longitudinal length along said axis of approximately 6.25" in said extended position of the blade.

25. Retractable knife as defined in claim 20, wherein said knife defines an axis and the longitudinal length along said axis in said retracted position of the blade is within the range of 35-45% of the longitudinal length in said extended position of the blade.

26. Retractable knife comprising a generally slim elongate handle having an upper edge generally proximate to the thumb of a user when held during normal use; defining a handle axis: a release button mounted for movements along said handle axis; a blade holder slidingly mounted within said handle responsive to actuation of said release button for sliding movements relative to said handle between a retracted position and an extended position in which at least a portion of said blade holder extends beyond said handle and having an upper edge, receiving means within said blade holder for receiving at least a portion of a blade provided with one edge formed with a cutting edge and opposing edge formed with a notch; a manually operable blade lock formed on said portion of said blade holder and comprising a rotatably mounted release member mounted on said blade holder, said release member having a first portion on said blade holder and mounted to be actuated by movement of a finger of the same hand of a user holding said handle along a direction substantially parallel to said handle axis, and a second portion mounted on said first portion for movements with said first portion between a locking position in which said second portion is received within a notch of a blade and a releasing position in which said second portion is removed from the blade notch to a position beyond the notch of the blade, said release member is substantially in the form of a disc having an axis substantially normal to said handle axis and rotatably mounted on said blade holder for rotation about said axis of rotation, said first portion at least partially projecting above said upper edge of said blade holder to always be exposed for engagement by the user in both said blade locking and blade releasing positions when said release member is actuated while said blade holder is extended along said handle axis beyond said handle at a position spaced from said release button in the direction of the blade to be removed, and biasing means for normally moving said release member to move said second portion to said locking position, said handle being formed with a gap or slot along at least a portion of said upper edge; and a release button extending above said upper edge and coupled to said blade holder, whereby actuation of said release button by the thumb of the user to slidingly move said blade holder while holding said handle slidably moves said blade holder between said retracted and extended positions.

* * * * *